US009566800B2

(12) United States Patent
Liu

(10) Patent No.: US 9,566,800 B2
(45) Date of Patent: Feb. 14, 2017

(54) SECURITY PATTERN APPLIED BY SELECTIVELY REMELTING INK WITHIN PRINTED AREAS

(71) Applicant: XEROX CORPORATION, Norwalk, CT (US)

(72) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 43 days.

(21) Appl. No.: 14/193,033

(22) Filed: Feb. 28, 2014

(65) Prior Publication Data

US 2015/0246552 A1 Sep. 3, 2015

(51) Int. Cl.

| | |
|---|---|
| ***B41J 2/165*** | (2006.01) |
| ***B41J 2/32*** | (2006.01) |
| ***B41J 2/325*** | (2006.01) |
| ***B42D 25/41*** | (2014.01) |
| ***B42D 25/29*** | (2014.01) |

(52) U.S. Cl.

CPC *B41J 2/32* (2013.01); *B41J 2/325* (2013.01); *B42D 25/29* (2014.10); *B42D 25/41* (2014.10)

(58) Field of Classification Search

None

See application file for complete search history.

(56) References Cited

U.S. PATENT DOCUMENTS

| | | | | |
|---|---|---|---|---|
| 2007/0231725 | A1* | 10/2007 | Riley et al. | 430/108.2 |
| 2013/0294803 | A1 | 11/2013 | Liu et al. | |
| 2014/0169849 | A1* | 6/2014 | Liu | 399/341 |

* cited by examiner

*Primary Examiner* — Alejandro Valencia

(74) *Attorney, Agent, or Firm* — Ronald E. Prass, Jr.; Prass LLP

(57) ABSTRACT

A system for producing a security feature on a physical printed document that has a first image printed on a first side of a piece of medium is provided. The system includes a security portion forming device that melts a marking substance that forms the security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

20 Claims, 2 Drawing Sheets

SECURITY PATTERN APPLIED BY SELECTIVELY REMELTING INK WITHIN PRINTED AREAS

BACKGROUND

Disclosed herein is a method and system for creating a security pattern on a printed page by remelting ink within a printed area.

Document security/product authentication has been a challenging issue for digital printing. Various image security features have been developed to strengthen the security of a digital print with a print length of one. It has been recognized that the level of security of a physical printed document is not determined by one or few features, but rather by the collection of many features. In addition, adding digital security features at a late stage of security document creation has been challenging.

SUMMARY

Solid ink printing jets ink at elevated temperatures above the melting point of the wax/resin of the ink. Ink drops solidify when contacting the substrate and the ink stays mostly on the surface of the substrate. When solid ink prints are heated again above the melting point, the ink becomes a low viscosity fluid and the ink will "soak" into the paper quickly (a few milliseconds) and result in a show-through (image is visible from the backside). This process happens particularly quick (ms) for uncoated substrate and the resulting show-through is very strong.

The disclosure proposes using a high power laser imager to overwrite an existing print made of hot melt inks/toners, including solid inkjet inks etc. Due to the very localized and short pulsed heating and cooling, the image will melt and become a low viscosity liquid that will soak into the paper quickly. This will create a show-through image (visible from the back of the print) that is visually distinct and unique compared to other security features available today. In addition, due the projective nature of the laser power delivery, the show-through image can be created even after a document has been sealed/laminated/overcoated from both sides. This security feature can be applied at a very late stage of security document creation, including long after the original document is created.

An embodiment of the disclosure may include a method of providing a security feature on a physical printed document, the method including printing a first image on a first side of a piece of medium to form a physical printed document; and heating a security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

Another embodiment of the disclosure may include a method of providing a security feature on a physical printed document, the document having a first image printed on a first side of a piece of medium, the method including heating a security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

Another embodiment of the disclosure may include a system for producing a security feature on a physical printed document, the document having a first image printed on a first side of a piece of medium, the system including a security portion forming device that melts a marking substance that forms the security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

DETAILED DESCRIPTION

Figure 1:
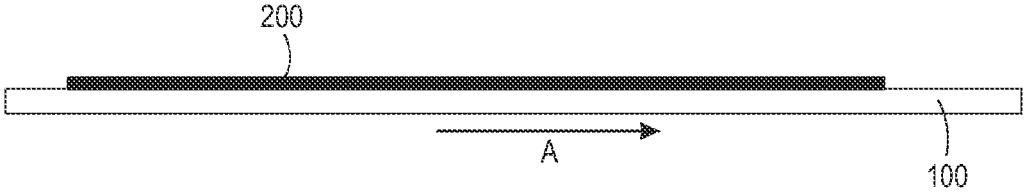
FIG. 1 is a schematic view of an example of a printed image on a sheet of medium.

Aspects of the embodiments disclosed herein relate to systems and methods that create a security feature in a physical printed document. The term "document" is used herein to mean a physical printed document.

The disclosed embodiments may include a method of providing a security feature on a document, the method including printing a first image on a first side of a piece of medium to form a document; and heating a security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

The disclosed embodiments may further include a method of providing a security feature on a document, the document having a first image printed on a first side of a piece of medium, the method including heating a security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

The disclosed embodiments may further include a system for producing a security feature on a document, the document having a first image printed on a first side of a piece of medium, the system including a security portion forming device that melts a marking substance that forms the security portion of the first image such that the security portion soaks into the piece of medium and is visible from a second side of the piece of medium, the second side being opposite to the first side. The security portion is less than the entire first image, and a remainder portion of the first image is equal to the entire first image less the security portion.

Embodiments of the disclosure take advantage of a high resolution, high power laser imager to create a show-through image. An exemplary process of the show-through image creation is as follows. A print is generated with hot melt toner/ink on the front side of a substrate. To make the ink re-flowable quickly, the ink is can be a low melting point resin/wax so that the transition to low viscosity fluid is sharp. In addition, the substrate can be porous, such as an uncoated paper. Optionally, the print can be laminated/coated from either side. A portion of the print is exposed. The exposed portion can be a portion of the print that has sufficient ink, and can be an ink color that absorbs the light at the laser wavelength. For example, a black ink area can be used, including if carbon black is used as the pigment and the laser wavelength is in the near IR range.

Laser pulse reheat provides beneficial reheating characteristics, including: (1) the heat is delivered in a very short time (for example, between 10 μs and 1 ms); (2) the heating is very localized resulting in very high resolution; and (3) cooling is very fast (for example, milliseconds) because the heating pulse is short and the molten ink cools quickly as it soaks through the substrate. As a result of these characteristics, a sharp show-through image is created.

FIG. 1 shows an example of a piece of medium 100 having an image 200 printed on a first side of medium 100. This can be, for example, an image printed by a solid ink printing system.

Figure 2:
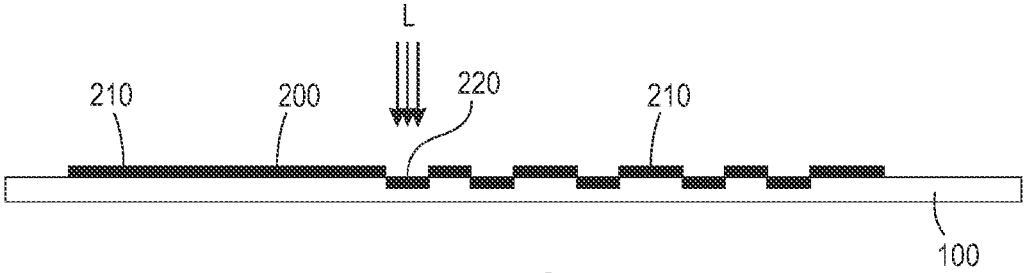
FIG. 2 is a schematic side view of an exemplary embodiment of the disclosure.

FIG. 2 shows image 200 being subjected to light L from a laser at only certain portions of image 200. In this figure, these certain portions are shown as soaking into medium 100 and will be referred to as security portions 220. The portions of image 200 that are not subjected to light L are designated as remaining portions 210 of image 200. Security portions 220 are melted by the laser, which allows the ink in these portions (now in liquid form) to soak into medium 100 such that the anchor and security portions 220 is deeper into medium 100 than remaining portions 210. FIG. 2 shows the ink in security portions 220 penetrating less than the entire depth of medium 100. However, in some situations, the ink in security portions 220 can penetrate the entire depth of medium 100.

The security portions can be created during the creation of the printed image, immediately after, or days or even years after.

Figure 3:
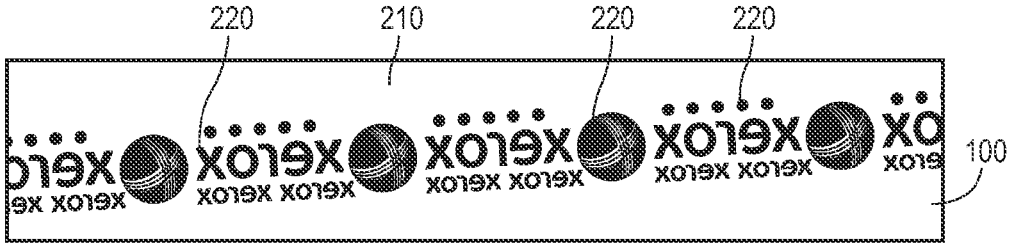
FIG. 3 is a schematic top view of an exemplary embodiment of the disclosure.

FIG. 3 shows an example of a second side, in this example the backside, of medium 100 that is opposite to the first side on which image 200 is printed. As can be seen in FIG. 3, security portions 220 are visible from the back side of medium 100, but remaining portions 210 are not. This creates a security feature that is extremely difficult, if not impossible, to erase.

This and similar embodiments of the disclosure provide a document having a normal looking image on a first side of a piece of medium while also having a security image on the opposite side that does not interfere with the appearance of the image on the first side.

Figure 4:
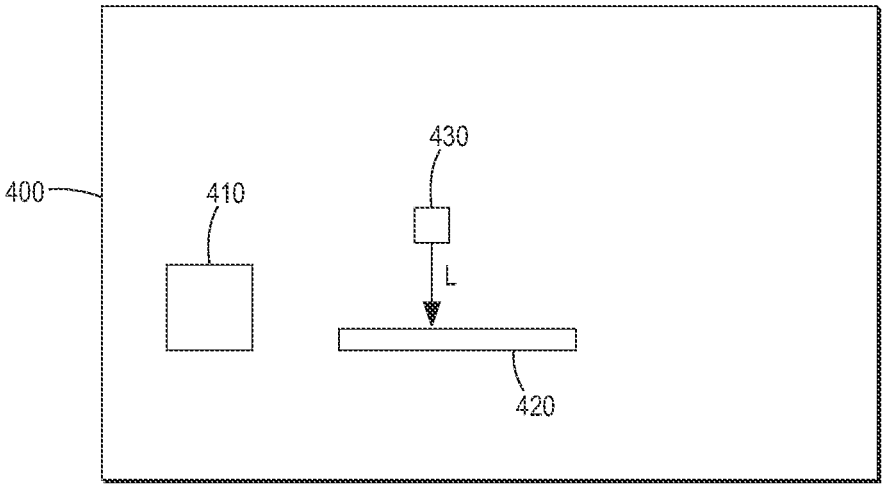
FIG. 4 is an exemplary embodiment of the disclosure.

FIG. 4 shows an example of a system 400 in accordance with embodiments of the disclosure. System 400 can include an image production device 410 that may include an image production section having hardware by which image signals are used to create a desired image, as well as a feeder section which stores and dispenses sheets on which images are to be printed. A security portion forming device 430 creates the security image by subjecting the security portions to heat, for example light L emitted from a laser. A document path 420 supports the document while the document is processed by security forming device 430.

Security portion forming device 430 may include a high power laser source to provide sufficient laser energy to cause an ink or toner image of a material to melt. For this purpose, the laser may serve as a heating device. Although the laser is described herein as a separate module, it may be possible that the laser may be implemented as part of another module or component of the system.

For some embodiments, the power of the laser energy from the laser may only be sufficient to cause melting of the image but not to cause evaporation of the image or the substrate. For example, the energy requirements may be 1 $kW/cm^2$ (or between 100 and 10000 $W/cm^2$) for power density, and 1 $J/cm^2$ (or between 0.1 and 10 $J/cm^2$) for energy density. This is different from the laser energy typically associated with laser ablation/engraving techniques where the laser energy is strong enough to be used in etching application of hard materials (e.g., stone, ceramic, etc.). For example, the typical laser energy requirements for laser ablation/engraving may be between 1 and 100 $MW/cm^2$ for power density, and between 1 and 100 $J/cm^2$ for energy density, where MW is Mega Watts. In addition, the laser ablation/engraving techniques may cause evaporation or removal of the material, whereas there is minimal or no evaporation or removal of the material caused by the embodiments of the present disclosure. U.S. patent application Ser. No. 13/462,485 is incorporated herein by reference.

Figure 5:
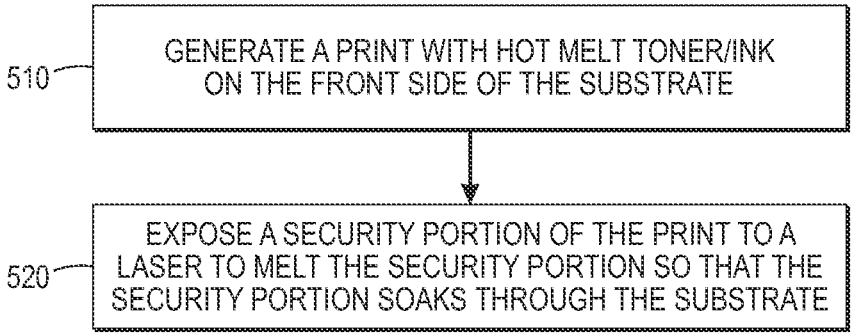
FIG. 5 is a flowchart of an exemplary method in accordance with one possible embodiment of the disclosure.

FIG. 5 is a flowchart that shows an example of a method of an embodiment of the disclosure. In step 510 a print is generated with hot melt toner/ink on the front side of a substrate. In step 520 a security portion of the print is exposed to a laser to melt the security portion so that the security portion soaks through substrate. As described above, this melted portion of the print creates an image that is visible from the back side of the substrate.

Due to the projective nature of the laser power delivery, the show-through image can be created even after a document/print has been sealed, laminated, or overcoated from both sides. The security portions can be created during the creation of the printed image, immediately after, or days or even years after. This security feature can be applied at a very late stage of security document/print creation, and can enable applications such as (1) including secure information after a security document (for example a badge) has been sealed from both sides; (2) for digital packaging/label/tag printing with overcoat applied, this technology can be used to add additional security/authentication information at a very late stage, such as at the point of sale, even after the package has been assembled.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for producing a security feature on a physical printed document, the document having a first image printed with a marking substance on a first side of a piece of medium and bonded to the first side of the piece of medium to form a bonded printed first image of the marking substance, the first image having a security portion and a remainder portion, the system comprising:

a security portion forming device that melts only a predetermined portion of the bonded marking substance less than the bonded printed first image of marking substance, the predetermined portion forming the security portion of the first image such that the security portion soaks into the piece of medium and is visible by an average human eye in standard office lighting from a second side of the piece of medium, the second side being opposite to the first side, wherein the bonding of the marking substance to the first side of the piece of medium is formed before the security portion forming device melts the predetermined portion of the bonded marking substance, wherein the security portion is less than the entire first image, and the remainder portion of the first image is equal to the entire first image less the security portion.

2. The system of claim 1, wherein the security portion forming device is configured to not cause the remainder portion to be visible by an average human eye in standard office lighting from the second side of the piece of medium.

3. The system of claim 1, wherein the security portion forming device is configured to cause the security portion to soak deeper into the piece of medium than does the remainder portion.

4. The system of claim 1, wherein the security portion forming device includes a laser, and a light beam of the laser melts the security portion so that it soaks into the piece of medium.

5. The system of claim 4, wherein the laser is configured to cause the light beam of the laser to penetrate a transparent layer on the first side before contacting the security portion of the image.

6. The system of claim 1, further comprising an image forming section that forms the bonded printed first image of the marking substance on the piece of medium.

7. The system of claim 6, wherein the security portion forming device is configured to cause the security portion to soak deeper into the piece of medium than does the remainder portion.

8. The system of claim 6, wherein the security portion forming device includes a laser, and a light beam of the laser melts the security portion so that it soaks into the piece of medium.

9. The system of claim 4, wherein the light beam of the laser melts the predetermined portion of the marking substance that forms the security portion so that the laser melted marking substance soaks into the piece of medium.

10. The system of claim 9, wherein the light beam of the laser overwrites the bonded printed marking substance within the predetermined portion of the marking substance that forms the security portion, the overwriting melting the predetermined portion of the marking substance without evaporation of the image.

11. The system of claim 4, wherein the light beam of the laser has a power density of between 100 and 10000 $W/cm^2$ and an energy density of between 0.1 and 10 $J/cm^2$.

12. The system of claim 6, the image forming section being an image production device that bonds the first image of solid inkjet ink on the piece of medium.

13. The system of claim 1, wherein the marking substance printed on the security portion of the bonded printed first image is identical to the marking substance printed on the non-predetermined portion of the bonded printed first image.

14. A method for producing a security feature on a physical printed document, the document having a first image printed with a marking substance on a first side of a piece of medium and bonded to the first side of the piece of medium to form a bonded printed first image of the marking substance, the first image having a security portion and a remainder portion, the method comprising:

melting only a predetermined portion of the bonded marking substance less than the bonded printed first image of marking substance with a security portion forming device, the predetermined portion forming the security portion of the first image such that the security portion soaks into the piece of medium and is visible by an average human eye in standard office lighting from a second side of the piece of medium, the second side being opposite to the first side, wherein the bonding of the marking substance to the first side of the piece of medium is formed before the security portion forming device melts the predetermined portion of the bonded marking substance, wherein the security portion is less than the entire first image, and the remainder portion of the first image is equal to the entire first image less the security portion.

15. The method of claim 14, further comprising, before the melting step, printing the first image on the first side of the piece of medium, wherein the melting does not cause the remainder portion to be visible by an average human eye in standard office lighting from the second side of the piece of medium.

16. The method of claim 14, wherein the melting causes the security portion to soak deeper into the piece of medium than does the remainder portion.

17. The method of claim 14, wherein the melting is performed by a laser.

18. The method of claim 17, wherein alight beam of the laser penetrates a transparent layer on the first side before contacting the security portion of the image.

19. The method of claim 14, further comprising, before the melting step, bonding the first image to the first side of the piece of medium.

20. The method of claim 14, wherein the marking substance printed on the security portion of the bonded printed first image is identical to the marking substance printed on the non-predetermined portion of the bonded printed first image.

* * * * *